United States Patent [19]

Shinkai

[11] Patent Number: 5,018,487

[45] Date of Patent: May 28, 1991

[54] VALVE TIMING MECHANISM WITH ECCENTRIC BUSHING ON ROCKER SHAFT

[75] Inventor: Tatsuya Shinkai, Shizuoka, Japan

[73] Assignee: Suzuki Jidosha Kogyo Kabushiki Kaisha, Shizuoka, Japan

[21] Appl. No.: 545,741

[22] Filed: Jun. 29, 1990

[30] Foreign Application Priority Data

Jun. 30, 1989 [JP] Japan ..... 1-168791

[51] Int. Cl.[5] ..... F01L 1/34

[52] U.S. Cl. ..... 123/90.16; 123/90.15

[58] Field of Search ..... 123/90.15, 90.16, 90.39, 123/90.43, 90.45

[56] References Cited

U.S. PATENT DOCUMENTS

| | | | |
|---|---|---|---|
| 3,641,988 | 2/1972 | Torazza et al. | 123/90.39 |
| 4,397,270 | 8/1983 | Aoyama | 123/90.16 |
| 4,438,736 | 3/1984 | Hara et al. | 123/90.16 |
| 4,503,818 | 3/1985 | Hara et al. | 123/90.16 |
| 4,506,635 | 3/1985 | van Rinsum | 123/90.43 |
| 4,526,142 | 7/1985 | Hara et al. | 123/90.16 |
| 4,643,141 | 2/1987 | Bledsoe | 123/90.16 |
| 4,724,822 | 2/1988 | Bonvallet | 123/90.16 |
| 4,768,475 | 9/1988 | Ikemura | 123/90.16 |

FOREIGN PATENT DOCUMENTS

| | | | |
|---|---|---|---|
| 3901967 | 8/1989 | Fed. Rep. of Germany | 123/90.45 |
| 0546801 | 11/1922 | France | 123/90.43 |
| 0114633 | 9/1979 | Japan | 123/90.16 |
| 0148910 | 11/1980 | Japan | 123/90.43 |

*Primary Examiner*—David A. Okonsky
*Assistant Examiner*—Weilun Lo
*Attorney, Agent, or Firm*—Schwartz & Weinrieb

[57] ABSTRACT

A valve moving mechanism for a four-cycle engine of a vehicle is operatively connected to a crank shaft of the engine and is adapted to move intake and exhaust valves. A cam shaft of the valve moving mechanism is operatively connected to the crank shaft and cam means including first, second and third cams is mounted upon the cam shaft, the second and third cams having outer profiles different from that of the first cam disposed between the second and third cams. Rocker arm means are mounted so as to be rotatable upon the rocker shaft which is rotatably mounted and includes first, second and third rocker arms driven in engagement with the first, second and third cams, respectively. The rocker arm means is operatively connected to the intake and exhaust valves, the first, second and third rocker arms having supporting bases mounted upon the rocker shaft. Bush means are mounted upon the rocker shaft so as to be selectively in engagement with the first, second and third rocker arms and has an axis eccentric with respect to the axis of the rocker shaft.

22 Claims, 6 Drawing Sheets

VALVE TIMING MECHANISM WITH ECCENTRIC BUSHING ON ROCKER SHAFT

FIELD OF THE INVENTION

The present invention relates to a four-cycle engine and more particularly to a valve moving mechanism for driving intake and exhaust valves of a four-cycle engine.

BACKGROUND OF THE INVENTION

Ordinarily, in a four-cycle engine mounted upon a vehicle such as, for example, an automobile or motorcycle, intake and exhaust valves are disposed above a combustion chamber and are driven by means of a valve moving mechanism.

The valve moving mechanism has a cam shaft interlocked with a crank shaft of the engine and the intake and exhaust valves are moved upwardly and downwardly in accordance with predetermined timing patterns by means of cams formed upon the cam shaft.

It is desirable for a four-cycle engine to have a large output throughout a wide range of engine speed including low and middle-high speed ranges, that is, to have a wide-range power band.

In conventional valve moving mechanisms, however, the valve opening-closing timing patterns and the valve lifting movements are fixed and the output characteristics are thereby restricted so that the output of the engine peaks within a particular engine speed range. Therefore, it is necessary to select one of the following two inconsistent patterns of engine output characteristics, one being based upon importance of achieving the engine output characteristics within a low speed range and the other being based upon the importance of achieving the engine output characteristics within a middle-high speed range.

OBJECT OF THE INVENTION

An object of the present invention is to substantially eliminate the defects or drawbacks encountered in connection with the conventional technology described above and to provide a valve moving mechanism particularly for a four-cycle engine of a vehicle which is capable of improving the output characteristics of the engine within a wide range of engine speed including low and middle-high speed ranges.

SUMMARY OF THE INVENTION

This and other objects can be achieved according to the present invention by providing a valve moving mechanism for a four-cycle engine of a vehicle which is operatively connected to a crank shaft of the engine and which is adapted to move the intake and exhaust valves of the engine, comprising a cam shaft operatively connected to the crank shaft, cam means including first, second and third cams mounted upon the cam shaft, the second and third cams having outer profiles different from that of the first cam disposed between the second and third cams, a rocker shaft supported so as to be pivotable about the longitudinal axis thereof, rocker arm means mounted so as to be pivotable about the rocker shaft axis and including first, second and third rocker arms driven in engagement with the first, second and third cams, respectively, the rocker arm means being operatively connected to the intake and exhaust valves, the first, second and third rocker arms having supporting bases mounted upon the rocker shaft, and bush means mounted upon the rocker shaft and being selectively in engagement with the first, second and third rocker arms and having an axis eccentric with respect to the axis of the rocker shaft.

In accordance with preferred embodiments of the present invention, and in accordance with one aspect thereof, the first rocker arm is provided with divergent front ends directly abutting against top portions of the intake and exhaust valves, the second and third rocker arms are provided with front ends abutting against the divergent front ends of the first rocker arm and the bush means is operatively engaged with the supporting bases of the second and third rocker arms.

In this embodiment, the supporting bases of the second and third rocker arms are moved downwardly relative to the supporting base of the first rocker arm as a result of the rotation of the large-diameter eccentric portions in response to pivotal rotation of the rocker shaft through means of a predetermined angle so that the abutment of the second and third rocker arms against the second and third cams is cancelled while the first rocker arm is brought into abutment against the first so as to move the valves by means of the first cam, and the supporting bases of the second and third rocker arms are moved upwardly relative to the supporting base of the first rocker arm as a result of the rotation of the large-diameter eccentric portions in response to pivotal rotation of the rocker shaft through means of a predetermined angle so that the abutment of the first rocker arm against the first cam is cancelled while the second and third rocker arms are brought into abutment against the second and third cams so as to move the valves by means of the second and third cams.

In accordance with another aspect of the present invention, the second and third rocker arms are provided with front ends directly abutting top portions of the intake and exhaust valves, the first rocker arm is provided with divergent front ends abutting against the front ends of the second and third rocker arms and the bush means is operatively engaged with the supporting bases of the second and third rocker arms.

In this embodiment, the supporting bases of the second and third rocker arms are moved downwardly relative to the supporting base of the first rocker arm as a result of the rotation of the large-diameter eccentric portions in response to the pivotal rotation of the rocker shaft through means of a predetermined angle so that the abutment of the second and third rocker arms against the second and third cams is cancelled while the first rocker arm is brought into abutment against the first cam so as to move the valves by means of the first cam, and the supporting bases of the second and third rocker arms are respectively moved upwardly relative to the supporting base of the first rocker arm as a result of the rotation of the large-diameter eccentric portions in response to pivotal rotation of the rocker shaft through means of a predetermined angle so that the abutment of the first rocker arm against the first cam is cancelled while the second and third rocker arms are respectively brought into abutment against the second and third cams so as to move the valves by means of the second and third cams.

In accordance with a further aspect of the present invention, the first rocker arm is provided with divergent front ends directly abutting top portions of the intake and exhaust valves, the second and third rocker arms are provided with front ends abutting the divergent front ends of the first rocker arm and the bush means is operatively engaged with the supporting base of the first rocker arm.

In accordance with this embodiment, the supporting base of the first rocker arm is moved downwardly relative to the supporting bases of the second and third rocker arms as a result of the rotation of the large-diameter eccentric portion in response to the pivotal rotation of the rocker shaft through means of a predetermined angle so that the abutment of the first rocker arm against the first cam is cancelled while the second and third rocker arms are brought into abutment against the second and third cams so as to move the valves by means of the second and third cams, and the supporting base of the first rocker arm is moved upwardly relative to the supporting bases of the second and third rocker arms as a result of the rotation of the large-diameter eccentric portion in response to the pivotal rotation of the rocker shaft through means of a predetermined angle so that the abutment of the second and third rocker arms against the second and third cams is cancelled while the first rocker arm is brought into abutment against the first cam so as to move the valves by means of the first cam.

In accordance with a still further aspect of the present invention, the second and third rocker arms are provided with front ends directly abutting top portions of the intake and exhaust valves, the first rocker arm is provided with divergent front ends abutting the front ends of the second and third rocker arms and the bush means is operatively engaged with the supporting base of the first rocker arm.

In accordance with this embodiment, the supporting base of the first rocker arm is moved downwardly relative to the supporting bases of the second and third rocker arms as a result of the rotation of the large-diameter eccentric portion in response to the pivotal rotation of the rocker shaft through means of a predetermined angle so that the abutment of the first rocker arm against the first cam is cancelled while the second and third rocker arms are brought into abutment against the second and third cams so as to move the valves by means of the second and third cams, and the supporting base of the first rocker arm is moved upwardly relative to the supporting bases of the second and third rocker arms as a result of the rotation of the large-diameter eccentric portion in response to the pivotal rotation of the rocker shaft through means of a predetermined angle so that the abutment of the second and third rocker arms against the second and third cams is cancelled while the first rocker arm is brought into abutment against the first cam so as to move the valves by means of the first cam.

The mechanism according to the present invention has two types of valve driving cams having different profiles. One of these cams to be used can be selected by selectively rotating the rocker shaft through means of a predetermined angle.

If one of these cams has a profile suitable for operation within a low engine speed range while the other has a profile suitable for operation within a middle-high engine speed range, the output from the four-cycle engine can be improved over a wide revolutionary speed range covering both the low and middle-high speed ranges.

In accordance with the valve moving mechanism of the present invention, the selection of the cams is effected by pivotably rotating the aforenoted large-diameter eccentric portions, and therefore there is no risk of application of large stresses to the respective portions, thereby enabling each cam to be smoothly selected.

Various other objects, features, and attendant advantages of the present invention will become better understood from the following detailed description, when considered in connection with the accompanying drawings, in which like reference characters designate like or corresponding parts throughout the several views, and wherein:

DETAILED DESCRIPTION OF THE PREFERRED EMBODIMENTS

The various embodiments of the present invention will now be described below with reference to the accompanying drawings.

Figure 1:
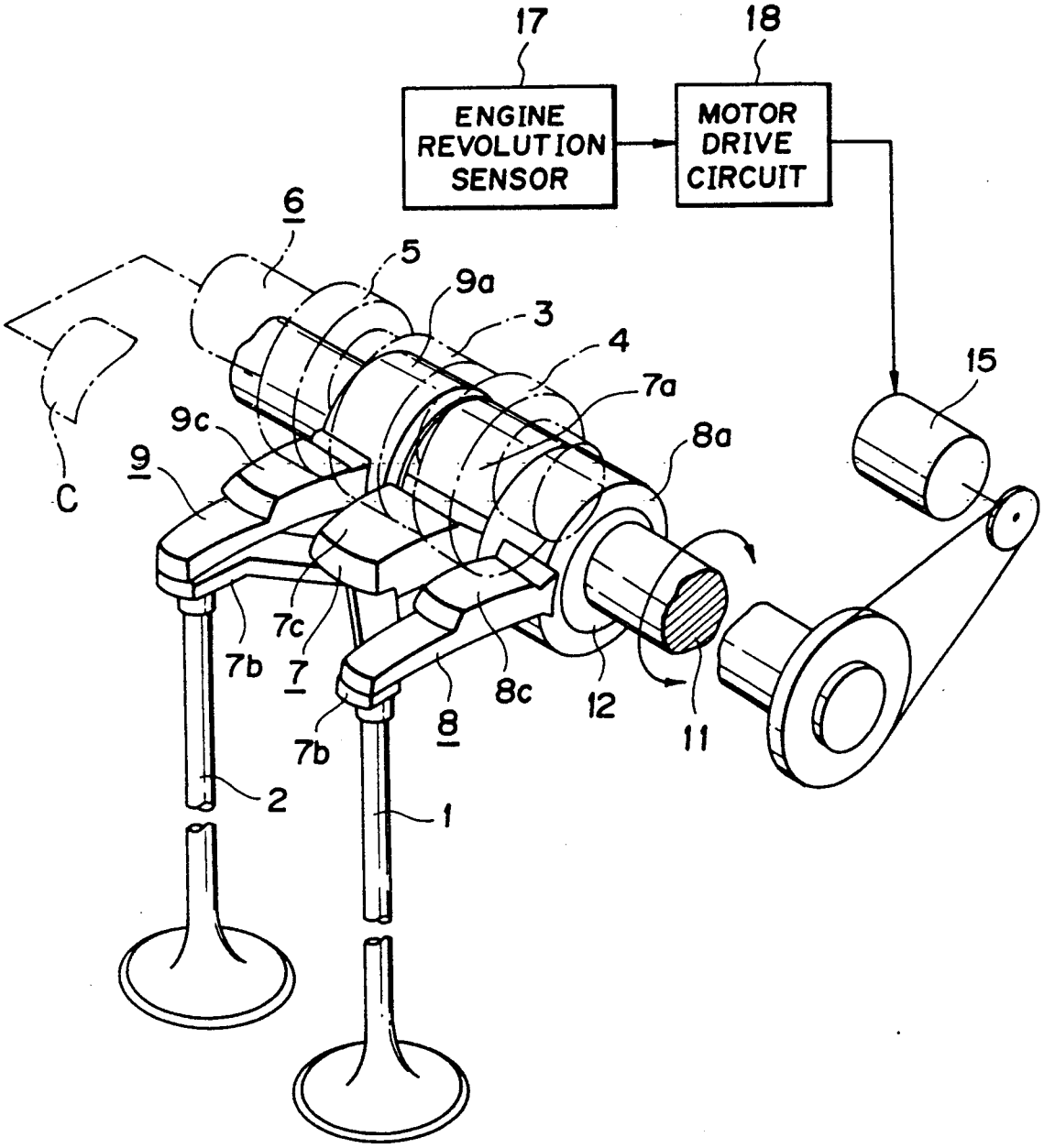
FIG. 1 is a schematic perspective view of an embodiment comprising a valve moving mechanism for a four-cycle engine constructed in accordance with first aspect of the present invention.

FIG. 1 schematically shows essential portions of a valve moving mechanism constructed according to the present invention.

Two valve moving mechanisms of this type are respectively provided upon the intake and exhaust sides of each cylinder of the engine. Accordingly, valves 1 and 2 shown in FIG. 1 are provided so as to effect intake or exhaust, accordingly, in connection with an intake valve and an exhaust valve.

This embodiment has a cam shaft 6 operatively connected to a crank shaft C of an engine and includes a cam 3 and cams 4 and 5 respectively positioned upon opposite sides of the cam 3, rocker arms 7, 8 and 9 respectively disposed below the cams 3, 4, and 5, and a rocker shaft 11 around which supporting bases 7*a*, 8*a* and 9*a* of the rocker arms 7, 8 and 9 are disposed and which is rotatably supported by means of unillustrated bearings.

The rocker arm 7 has two end portions divergent in two directions, and two diverging ends 7*b* respectively abut against stem head portions of the valves 1 and 2 for closing the combustion chamber of the unillustrated engine cylinder.

The supporting base 8a of the rocker arm 8 is pivotably mounted upon the rocker shaft 11 by means of a bush 12 having a diameter larger than the rocker shaft and interposed therebetween.

The axis of the bush 12 is eccentric from the axis of the rocker shaft 11, and the bush 12 is fixed to the shaft 11 by means of an unillustrated pin. The bush 12 functions as an eccentric large-diameter portion of the rocker shaft 11.

Figure 2:
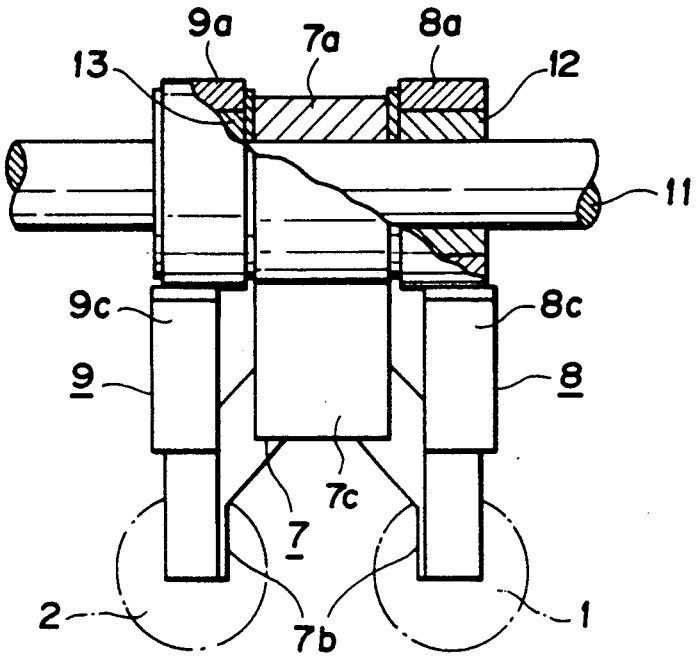
FIG. 2 is a plan view of the valve moving mechanism of the aforenoted embodiment.

As shown in FIG. 2, the supporting base 9a of the rocker arm 9 is also pivotably mounted upon the rocker shaft 11 by means of a bush 13 interposed therebetween. The bush 13 has the same shape and is eccentric in the same direction as is the bush 12.

Lower surfaces of distal end portions of the rocker arms 8 and 9 abut against the diverging distal end portions 7b of the rocker arm 7. If a cam follower surface 7c of the rocker arm 7 is depressed so as to move the distal end portions 7b downwardly, the distal end portions of the rocker arms 8 and 9 also move downwardly by following the downward movement of the distal end portions 7b.

If cam follower surfaces 8c and 9c of the rocker arms 8 and 9 are depressed, the distal end portions of the arms 8 and 9 depress the distal end portions 7b of the rocker arm 7, thereby forcibly moving the distal end portions 7b downwardly.

With respect to the cams 3, 4, and 5, the cams 4 and 5 have identical profiles, and the cam 3 has a profile different from that of the cams 4 and 5.

The profile of the cam 3 is determined so as to obtain a valve lift movement or operation suitable for operation of the engine within a low speed range. The profile of the cams 4 and 5 is determined so as to obtain a valve lift movement or operation suitable for engine operation within a middle-high speed range.

Figure 14:
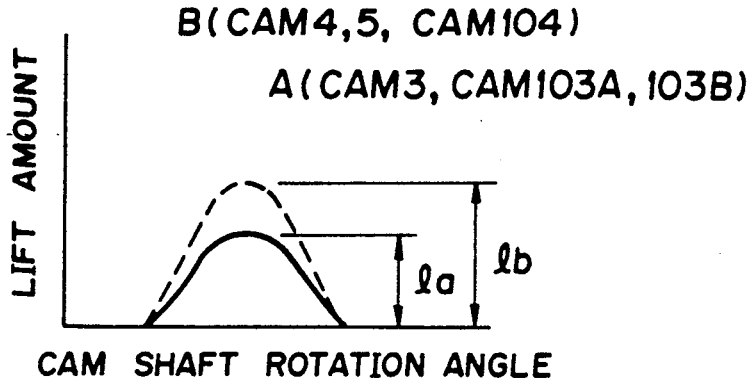
FIGS. 14 to 16 are graphs representing the valve lift characteristics of the various components as utilized within the various embodiments of the invention, respectively.

These valve lift movements correspond to stroke lengths of the valves 1 and 2. In FIG. 14 the symbol la represents the valve lift based upon the drive of the cam 3 and the symbol lb represents the valve lift based upon the drive of the cams 4 and 5.

As is apparent from FIG. 14, the cam profiles are determined so that the valve lift obtained by means of the cams 4 and 5 is larger than that obtained by means of the cam 3.

The operation of this embodiment will now be described hereunder.

An engine revolution sensor 17 detects the engine speed and outputs a signal corresponding to the engine speed.

A motor drive circuit 18 shown in FIG. 1 determines by comparison with respect to predetermined speed values whether the engine speed represented by means of the value of the signal output from the sensor 17 is within the low speed range or within the middle-high speed range. If the engine speed is within the low speed range, a motor 15 is driven so as to rotate the rocker shaft 11 so that the eccentric bushes 12 and 13 are disposed at their angular positions shown in FIG. 3. If the engine speed is within the middle-high speed range, the motor 15 is driven so as to rotate the rocker shaft 11 so that the eccentric bushes 12 and 13 are disposed at their angular positions shown in FIG. 4.

Figure 3:
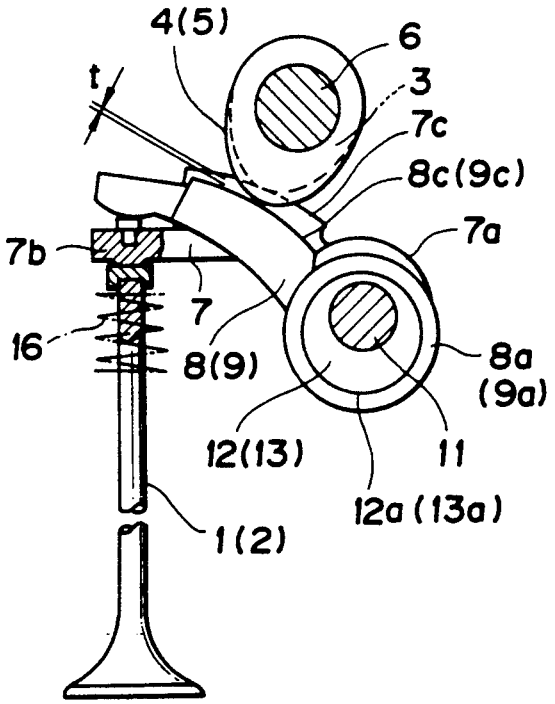
FIGS. 3 and 4 are moving state diagrams showing the operation of the valve moving mechanism of the aforenoted embodiment.

In the state shown in FIG. 3, portions 12a and 13a of the eccentric bushes 12 and 13 are disposed at lower positions such that the supporting bases 8a and 9a of the rocker arms 8 and 9 are moved downwardly relative to the supporting base 7a of the rocker arm 7.

A gap t is thereby formed between the peripheral surfaces of the cams 4 and 5 and the cam follower surfaces 8c and 9c of the rocker arms 8 and 9. Consequently, the cams 4 and 5 rotate without encountering the rocker arms 8 and 9.

On the other hand, since the rocker arm 7 is always lifted by being swung upwardly about the axis of the rocker shaft 11 by means of the biasing force of a valve spring 16, the cam follower surface 7c of the rocker arm 7 abuts against the peripheral surface of the cam 3. As a result, as the cam shaft 6 rotates, the valves 1 and 2 are moved upwardly and downwardly in accordance with the lift characteristics A shown in FIG. 14. That is, the valves 1 and 2 are moved so as to open or close the combustion chamber in accordance with valve lift characteristics suitable for low engine speed range operation.

Figure 4:
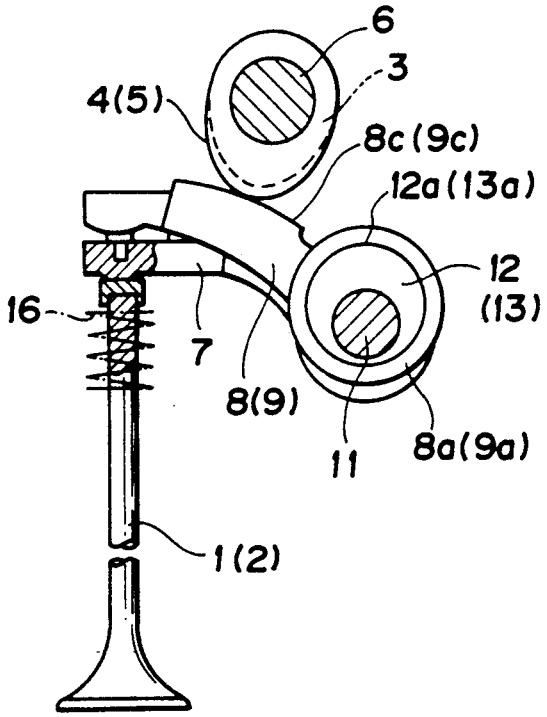

In the state shown in FIG. 4, the portions 12a and 13a of the eccentric bushes 12 and 13 are disposed at the upper positions such that the supporting bases 8a and 9a of the rocker arms 8 and 9 are moved upwardly relative to the supporting base 7a of the rocker arm 7, whereby the cam follower surfaces 8c and 9c of the rocker arms 8 and 9 respectively abut against the peripheral surfaces of the cams 4 and 5.

As shown in FIG. 14, the cams 4 and 5 are formed so as to have a larger cam lift movement in comparison with that of the cam 3. Consequently, in the state shown in FIG. 4, as the cam shaft 6 is rotated, the cam 3 rotates freely without encountering the rocker arm 7, while the cams 4 and 5 respectively operate the rocker arm 7 through means of the rocker arms 8 and 9.

As a result, the valves 1 and 2 are moved so as to open or close the combustion chamber the particular engine cylinder in accordance with the noted valve lift movements suitable for the middle-high engine speed range, that is in accordance with the lift characteristic B shown in FIG. 14.

Figure 15:
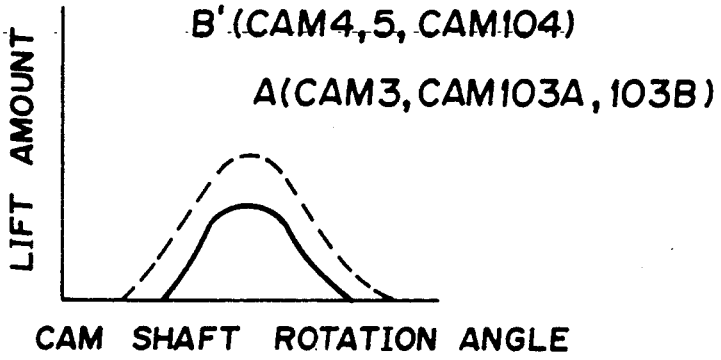
Figure 16:
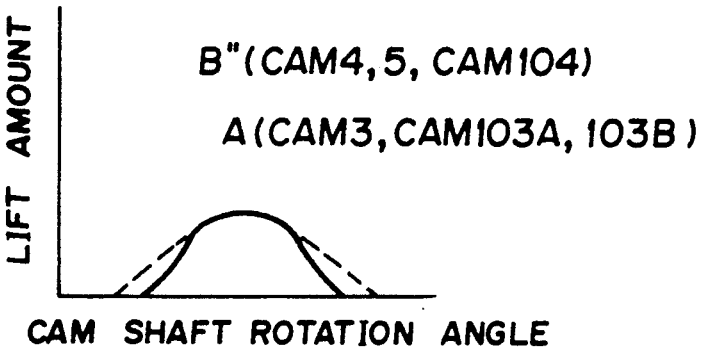

In the above-described embodiment, the profiles of the cams 4 and 5 may be changed so as to obtain valve lift characteristics B′ and B″ such as those shown in FIGS. 15 and 16 during operation within the middle-high engine speed range.

It is further noted that one of the rocker arms 8 and 9 shown in FIG. 2 may be omitted. In such a case, however, the depressing force cannot be uniformly applied to the extreme end portions of the rocker arms 7 and, therefore, is a risk that a difference between the lift movements of the valves 1 and 2 will occur.

During high-speed rotation of the cams 4 and 5, there is a risk that the rocker arms 8 and 9 move freely and generate noise.

In order to avoid this problem, a suitable spring means may be used so as to bias the rocker arms 8 and 9 in the counterclockwise direction as viewed in FIG. 3 with respect to the rocker arm 7. The lower surfaces of the distal end portions of the rocker arms 8 and 9 can thereby be forcibly made to abut against the distal end portions 7b of the rocker arm 7, thereby enabling the rocker arms 8 and 9 to follow the movement of the rocker arm 7. It is thus possible to prevent the occurrence of noise due to the uncontrolled movement of the rocker arms 8 and 9.

Figure 5:
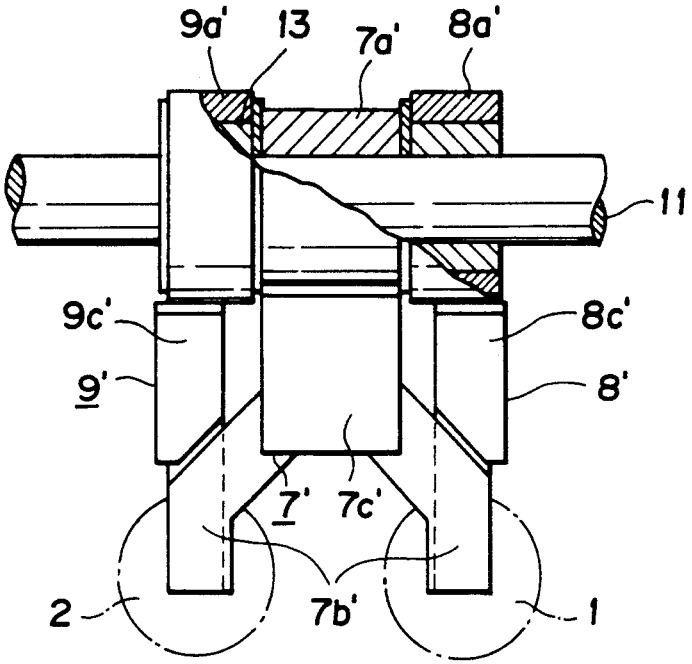
FIG. 5 is a plan view of another embodiment of a valve moving mechanism constructed in accordance with a second aspect of the present invention.

FIG. 5 shows another embodiment of the present invention. Components of this embodiment identical to those shown in connection with the embodiment of FIG. 1 are indicated by means of the same reference numerals, and corresponding components are indicated by means of corresponding numerals with primes.

Figure 6:
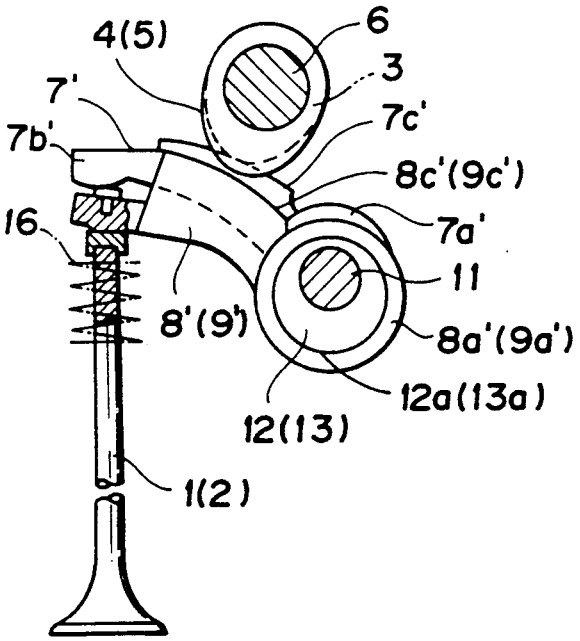
FIGS. 6 and 7 are moving state diagrams showing the operation of the embodiment shown in FIG. 5.

In this embodiment, as shown in FIG. 6, the distal end portions of rocker arms 8' and 9' directly abut against stem head portions of valves 1 and 2, while the diverging distal end portions 7b' of the rocker arm 7' respectively abut against upper surfaces of the distal end portions of the rocker arms 8' and 9'.

Figure 7:
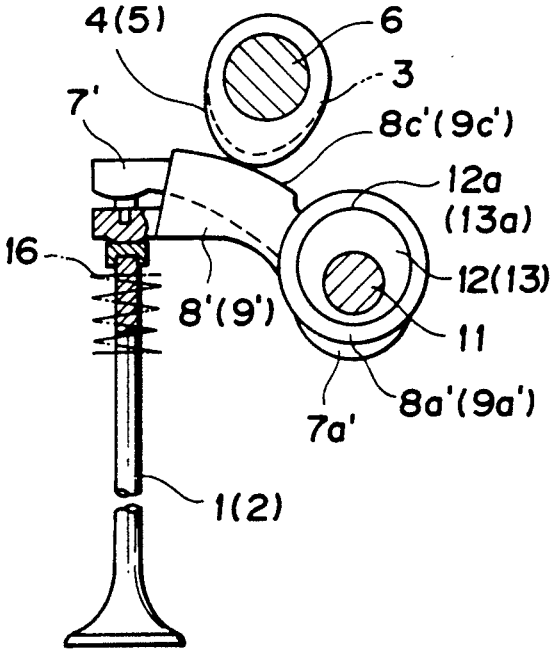

FIG. 6 shows the state in which the portions 12a and 13a of eccentric bushes 12 and 13 are disposed downwardly, while FIG. 7 shows the state in which the portions 12a and 13a of the eccentric bushes 12 and 13 are disposed upwardly.

The states shown in FIGS. 6 and 7 are predetermined by controlling the rotation of the rocker shaft 11 by means of the motor 15 shown in FIG. 1.

When the bushes 12 and 13 are at the rotational position shown in FIG. 6, the cam follower surface 7c' of the rocker arm 7' abuts against the cam 3 while cam follower surfaces 8c' and 9c' of the rocker arms 8' and 9' are spaced apart from the cams 4 and 5.

The motion of the rocker arm 7' caused by means of the rotation of the cam 3 is transmitted to the valves 1 and 2 through means of the rocker arms 8' and 9', respectively, thereby moving the valves 1 and 2 for valve opening or closing operations in accordance with the characteristic curve A shown in FIG. 14.

On the other hand, when the bushes 12 and 13 are disposed at the rotational position shown in FIG. 7, the cam follower surface 7c' of the rocker arm 7' is spaced apart from the cam 3 while the cam follower surfaces 8c' and 9c' of the rocker arms 8' and 9' abut against the cams 4 and 5, respectively.

Consequently, the motions of the rocker arms 8' and 9' caused by means of the rotation of the cams 4 and 5 are directly transmitted to the valves 1 and 2, respectively, thereby moving the valves 1 and 2 for valve opening or closing operations in accordance with the characteristic curve B shown in FIG. 14. At this time, the rocker arm 7' moves under the influence of its own weight so as to follow the movements of the rocker arms 8' and 9'.

In this embodiment, in the state shown in FIG. 7, there is a risk that the rocker arm 7' will move freely and thereby generate noise. It is therefore preferable to bias the rocker arm 7' in the counterclockwise direction by means of a suitable spring means mounted upon the rocker arms 8' or 9'. The distal end portion of the arm 7' can therefore be pressed against the distal end portions of the arms 8' and 9', thereby enabling the arm 7' to move in accordance with the movements of the arms 8' and 9'. It is therefore possible to prevent the occurrence of noise due to the free movement of the arm 7'.

Figure 8:
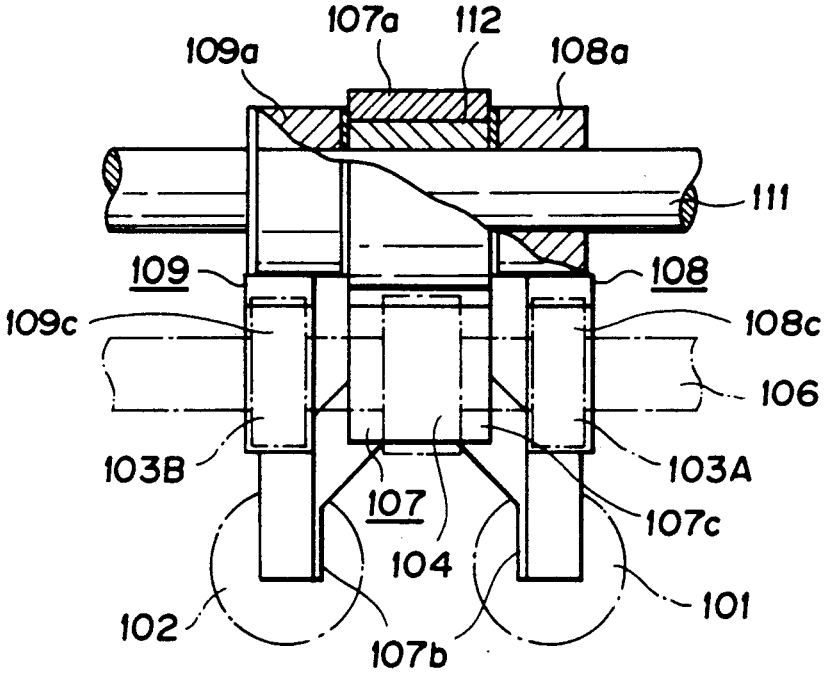
FIG. 8 is a plan view of still another embodiment of a valve moving mechanism constructed in accordance with a third aspect of the present invention.

FIG. 8 shows still another embodiment of the present invention.

This embodiment comprises a cam shaft 106 having a cam 104 and cams 103B and 103A respectively positioned upon opposite sides of the cam 104, rocker arms 107, 108 and 109 respectively disposed below the cams 104, 103A and 103B, and a rocker shaft 111 around which supporting bases 107a, 108a and 109a of the rocker arms 107, 108 and 109 are disposed and which is rotatably supported by means of unillustrated bearings.

The cam 104 has the same cam profile as that of the cam 4 shown in FIG. 1 and the cams 103A and 103B have the same cam profile as that of the cam 3 shown in FIG. 1.

The rocker arm 107 has two distal end portions diverging in two directions, as in the case of the rocker arm 7 shown in FIG. 1, and the diverging ends 107b respectively abut against stem head portions of the valves 101 and 102.

The supporting base 107a of the rocker arm 107 is rotatably mounted upon the rocker shaft 111 with a bush 112, having a diameter larger than that of the rocker shaft 111, interposed therebetween.

Figure 9:
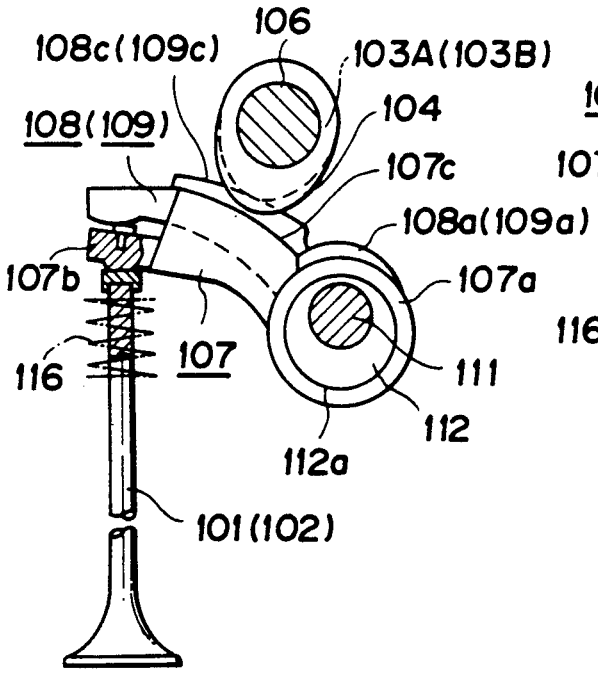
FIGS. 9 and 10 are moving state diagrams showing the operation of the embodiment shown in FIG. 8.

The bush 112 has the same contour as that of the bush 12 shown in FIG. 1 and is fixed to the shaft 111 by means of a pin or the like so as to have an eccentricity relative to the axis of the rocker shaft 111, as shown in FIG. 9.

The bush 112 therefore functions as a large-diameter eccentric portion of the cam shaft 111.

The supporting bases 108a and 109a of the rocker arms 108 and 109 are rotatably supported upon portions of the rocker shaft 111 other than the large-diameter eccentric portion of the same. Lower surfaces of distal end portions of the rocker arms 108 and 109 respectively abut against the distal end portions 107b of the rocker arm 107.

The operation of this embodiment will now be described below.

Figure 10:
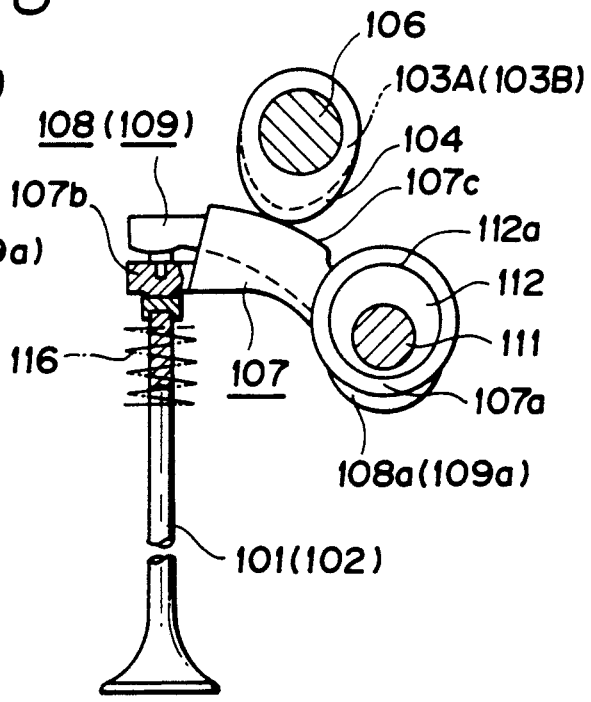

The rocker shaft 111 is rotated through means of a predetermined angle by means of the motor 15 shown in FIG. 1. That is, if the engine speed detected by means of the sensor 17 shown in within FIG. 1 is in a low speed range, the rocker shaft 111 is rotated so that the eccentric portion 112a of the eccentric bush 112 is disposed downwardly as shown in FIG. 9. Alternatively, if the engine speed is within a middle-high speed range, the rocker shaft 111 is rotated so that the portion 112a of the eccentric bush 112 is disposed upwardly as shown in FIG. 10.

In the state shown in FIG. 9, the portion 112a of the eccentric bush 112 is at its lower position such that the supporting base 107a of the rocker arm 107 is moved downwardly relative to the supporting bases 108a and 109a of the rocker arms 108 and 109.

Consequently, the abutment of the cam follower surface 107c of the rocker arm 107 against the peripheral surface of the cam 104 is cancelled, thereby permitting the cam 104 to rotate freely without encountering the rocker arm 107 or its cam follower surface 107a.

On the other hand, since the rocker arms 108 and 109 are always lifted by being swung upwardly about the axis of the rocker shaft 111 by means of the biasing force of a valve spring 116, cam follower surfaces 108c and 109c of the rocker arms 108 and 109 abut against the peripheral surfaces of the cams 103A and 103B. Consequently, as the cam shaft 106 rotates, the valves 101 and 102 are moved upwardly and downwardly in accordance with the lift characteristic curve A shown in FIG. 14. That is, the valves 101 and 102 are moved so as to open or close the combustion chamber of the particular cylinder in accordance with the valve lift operations suitable for low engine speed range operation.

In the state shown in FIG. 10, the portion 112a of the eccentric bush 112 is at an upper position such that the supporting base 107a of the rocker arm 107 is moved upwardly relative to the supporting bases 108a and 109a of the rocker arms 108 and 109. The cam follower surface 107c of the rocker arm 107 is thereby brought into abutment against the peripheral surface of the cam 104.

Consequently, as the cam shaft 106 rotates, the cams 103A and 103B rotate freely without encountering the cam follower surfaces 108c and 109c of the rocker arms 108 and 109, respectively, while the cam 104 drives the rocker arm 107 as a result of encountering the cam follower surface 107c thereof.

As a result, the valves 101 and 102 are moved so as to open or close the combustion chamber of the particular cylinder in accordance with the lift characteristic curve B shown in FIG. 14, that is, in accordance with the valve lift movements suitable for the middle-high engine speed range operation.

In connection with the above-described embodiment, one of the rocker arms 108 and 109 may be omitted. In such a case, however, the depressing force cannot be uniformly applied to both distal end portions 107b of the rocker arms 107, and therefore there is a risk that a difference between the lift movements of the valves 101 and 102 may occur.

In the state shown in FIG. 10, there is a risk that the rocker arms 108 and 109 will move freely and thereby generate noise. In this embodiment, therefore, a suitable spring means is used so as to bias the distal end portions of the rocker arms 108 and 109 toward the distal end portions 107b of the rocker arm 107, thereby preventing the occurrence of noise due to the free movement of the rocker arms 108 and 109.

Figure 11:
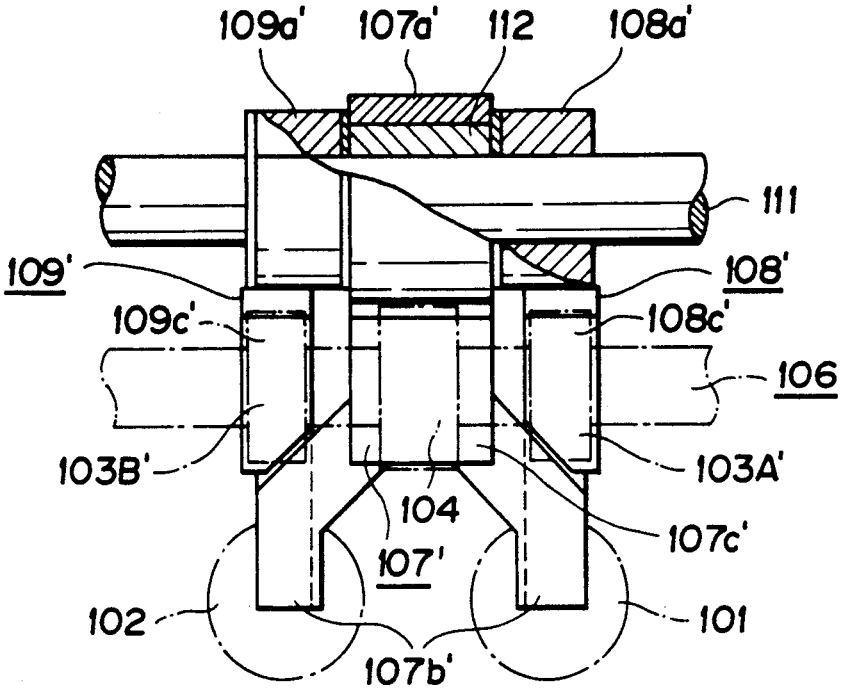
FIG. 11 is a plan view of a further embodiment of a valve moving mechanism constructed in accordance with a fourth aspect of the present invention.

FIG. 11 discloses a further embodiment of the present invention. Components of this embodiment identical to those shown in connection with the embodiment of FIG. 8 are indicated by means of the same reference numerals and corresponding components are indicated by means of corresponding numerals with primes.

Figure 12:
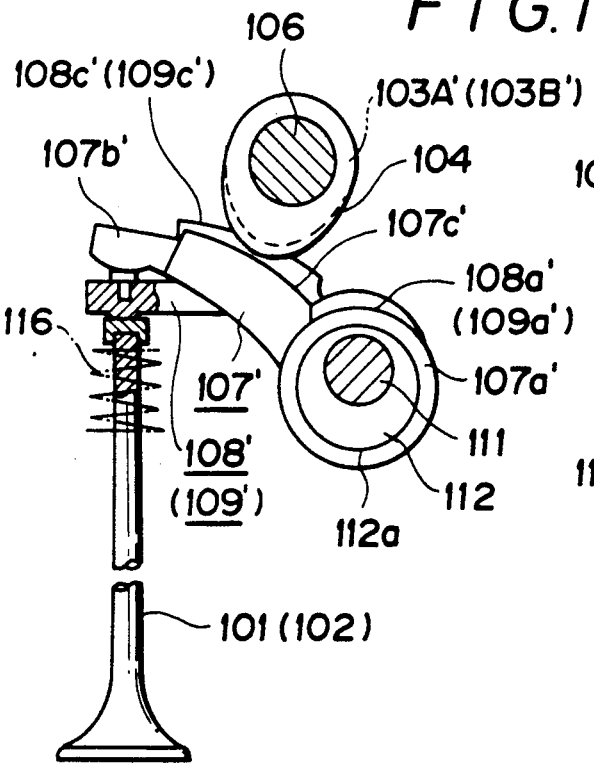
FIGS. 12 and 13 are moving state diagrams showing the operation of the embodiment shown in FIG. 11.

In this embodiment, as shown in FIG. 12, distal end portions of rocker arms 108' and 109' directly abut against stem head portions of valves 101 and 102, while diverging distal end portions 107b' of a rocker arm 107' respectively abut against upper surfaces of the distal end portions of the rocker arms 108' and 109'.

Figure 13:
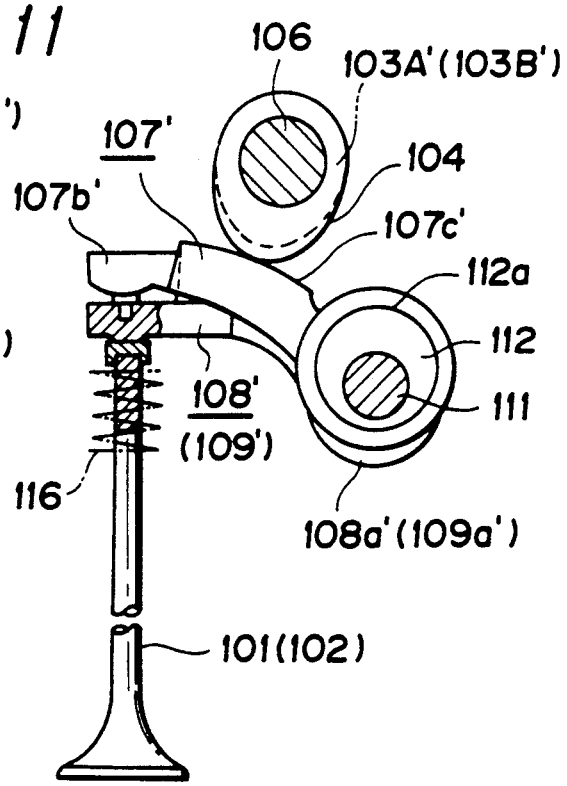

FIG. 12 shows a state in which an eccentric portion 112a of the eccentric bush 112 is disposed downwardly and FIG. 13 shows a state in which the eccentric portion 112 is disposed downwardly.

The states shown in FIGS. 12 and 13 are predetermined by controlling the rotation of the rocker shaft 111 by means of the motor 15 shown in FIG. 1.

When the bush 112 is disposed at the rotational position shown in FIG. 12, cam follower surfaces 108c' and 109c' of the rocker arms 108' and 109' abut against the cams 103A' and 103B' while the cam follower surface 107c' of the rocker arm 107' is spaced apart from the cam 104.

Consequently, as the cams 103A' and 103B' are rotated, the motions of the rocker arms 108' and 109' are transmitted directly to the valves 101 and 102, respectively, thereby effecting lift movements of the valves 101 and 102 in accordance with the characteristic curve A shown in FIG. 14.

At this time, the rocker arm 107' moves under the influence of its own weight so as to follow the movements of the rocker arms 108' and 109'.

When the bush 112 is disposed at the rotational position shown in FIG. 13, the cam follower surfaces 108c' and 109c' of the rocker arms 108' and 109' are spaced apart from the cams 103A' and 103B' while the cam follower surface 107c' of the rocker arm 107' abuts against the cam 104.

Consequently, the motion of the rocker arm 107' caused by means of the rotation of the cam 104 is transmitted to the valves 101 and 102 through means of the distal end portions of the rocker arms 108' and 109', respectively, thereby effecting lift movements of the valves 101 and 102 in accordance with the characteristic curve B shown in FIG. 14. In the state shown in FIG. 12, there is a risk of that the rocker arm 107' will move freely. In this embodiment, therefore, a suitable spring means (not shown) is used so as to bias the distal end portions 107b' of the rocker arm 107' against the distal end portions of the rocker arms 108' and 109', thereby preventing the occurrence of noise due to the free movement of the rocker arm 107'.

In the embodiment shown in FIGS. 8 and 11, the profile of the cam 104 may be changed so as to enable the valves 101 and 102 to be lifted in accordance with the lift characteristic curves B' and B'' shown in FIGS. 15 and 16 during operation within the middle-high engine speed range.

In each of the above-described embodiments, the motor 15 shown in FIG. 1 is used as a rotational drive source for the rocker shafts. Alternatively, a hydraulic or pneumatic cylinder may be used as the drive source. In such a case, a rack and a pinion are used as a power transmitting means.

Obviously, many modifications and variations of the present invention are possible in light of the above teachings. It is therefore to be understood that within the scope of the appended claims, the present invention may be practiced otherwise than as specifically described herein.

What is claimed is:

1. A valve moving mechanism, for a four-cycle engine of a vehicle, operatively connected to a crank shaft of said engine and adapted to move one of a respective pair of intake and exhaust valves, comprising:

a cam shaft operatively connected to said crank shaft;

cam means, including first, second, and third cams, mounted upon said cam shaft, said second and third cams having outer profiles different from that of said first cam which is disposed between said second and third cams;

a rocker shaft rotatable about an axis thereof;

rocker arm means rotatably mounted upon said rocker shaft and including first, second, and third rocker arms driven by engagement with said first, second, and third cams, respectively, said rocker arm means being operatively connected to said one respective pair of intake and exhaust valves, said first, second, and third rocker arms having supporting bases mounted upon said rocker shaft; and bush means mounted upon said rocker shaft so as to be in engagement with at least one of said first, second, and third rocker arms, said bush means including an axis eccentric with respect to said axis of said rocker shaft.

2. A valve moving mechanism according to claim 1, wherein said first rocker arm is provided with divergent front ends directly abutting against end portions of said intake and exhaust valves, and said second and third rocker arms are provided with front ends abutting against the divergent front ends of said first rocker arm, and said bush means is operatively engaged with the supporting bases of said second and third rocker arms.

3. A valve moving mechanism according to claim 1, wherein said second and third rocker arms are provided with front ends abutting directly against end portions of said intake and exhaust valves, said first rocker arm is provided with divergent front ends abutting against the front ends of said second and third rocker arms, and said bush means is operatively engaged with the supporting bases of said second and third rocker arms.

4. A valve moving mechanism according to claim 1, wherein said first rocker arm is provided with divergent front ends abutting directly against end portions of said intake and exhaust valves, said second and third rocker arms are provided with front ends abutting against the divergent front ends of said first rocker arm, and said bush means is operatively engaged with the supporting base of said first rocker arm.

5. A valve moving mechanism according to claim 1, wherein said second and third rocker arms are provided with front ends abutting directly against end portions of said intake and exhaust valves, said first rocker arm is provided with divergent front ends abutting against the front ends of said second and third rocker arms, and said bush means is operatively engaged with the supporting base of said first rocker arm.

6. A valve moving mechanism as set forth in claim 2, further comprising:

means for rotating said rocker shaft to a first position, when said engine is operating within a low engine-speed range, such that said second and third rocker arms will be out of engagement with said second and third cams, while said first rocker arm will be in engagement with said first cam as said cam shaft is rotated.

7. A valve moving mechanism as set forth in claim 2, further comprising:

means for rotating said rocker shaft to a second position, when said engine is operating within a middle-high engine-speed range, such that said second and third rocker arms will be in engagement with said second and third cams, while said first rocker arm will be out of engagement with said first cam as said cam shaft is rotated.

8. A valve moving mechanism as set forth in claim 6, wherein said means for rotating said rocker shaft comprises:

engine revolution sensing means for detecting said engine speed and for outputting a signal indicative of said engine speed; and motor drive means for determining, in response to said output signal from said engine revolution sensing means, that said speed of said engine is within said low engine-speed range, and for driving said rocker shaft to said first position as a result of said determination that said speed of said engine is within said low engine-speed range.

9. A valve moving mechanism as set forth in claim 7, wherein said means for rotating said rocker shaft comprises:

engine revolution sensing means for detecting said engine speed and for outputting a signal indicative of said engine speed; and motor drive means for determining, in response to said output signal from said engine revolution sensing means, that said speed of said engine is within said middle-high engine-speed range, and for driving said rocker shaft to said second position as a result of said determination that said speed of said engine is within said middle-high engine-speed range.

10. A valve moving mechanism as set forth in claim 1, wherein:

said cam shaft is rotatable about an axis disposed parallel to said axis of said rocker shaft.

11. A valve moving mechanism as set forth in claim 3, further comprising:

means for rotating said rocker shaft to a first position, when said engine is operating within a low engine-speed range, such that said second and third rocker arms will be out of engagement with said second and third cams, while said first rocker arm will be in engagement with said first cam as said cam shaft is rotated.

12. A valve moving mechanism as set forth in claim 3, further comprising:

means for rotating said rocker shaft to a second position, when said engine is operating within a middle-high engine-speed range, such that said second and third rocker arms will be in engagement with said second and third cams, while said first rocker arm will be out of engagement with said first cam as said cam shaft is rotated.

13. A valve moving mechanism as set forth in claim 11, wherein said means for rotating said rocker shaft comprises:

engine revolution sensing means for detecting said engine speed and for outputting a signal indicative of said engine speed; and motor drive means for determining, in response to said output signal from said engine revolution sensing means, that said speed of said engine is within said low engine-speed range, and for driving said rocker shaft to said first position as a result of said determination that said speed of said engine is within said low engine-speed range.

14. A valve moving mechanism as set forth in claim 12, wherein said means for rotating said rocker shaft comprises:

engine revolution sensing means for detecting said engine speed and for outputting a signal indicative of said engine speed; and motor drive means for determining, in response to said output signal from said engine revolution sensing means, that said speed of said engine is within said middle-high engine-speed range, and for driving said rocker shaft to said second position as a result of said determination that said speed of said engine is within said middle-high engine speed range.

15. A valve moving mechanism as set forth in claim 4, further comprising:

means for rotating said rocker shaft to a first position, when said engine is operating within a low engine-speed range, such that said second and third rocker arms will be in engagement with said second and third cams, while said first rocker arm will be out of engagement with said first cam as said cam shaft is rotated.

16. A valve moving mechanism as set forth in claim 4, further comprising:

means for rotating said rocker shaft to a second position, when said engine is operating within a middle-high engine-speed range, such that said second and third rocker arms will be out of engagement with said second and third cams, while said first rocker arm will be in engagement with said first cam as said cam shaft is rotated.

17. A valve moving mechanism as set forth in claim 15, wherein said means for rotating said rocker shaft comprises:

engine revolution sensing means for detecting said engine speed and for outputting a signal indicative of said engine speed; and motor drive means for determining, in response to said output signal from said engine revolution sensing means, that said speed of said engine is within said low engine-speed range, and for driving said rocker shaft to said first position as a result of said determination that said speed of said engine is within said low engine-speed range.

18. A valve moving mechanism as set forth in claim 16, wherein said means for rotating said rocker shaft comprises:

engine revolution sensing means for detecting said engine speed and for outputting a signal indicative of said engine speed; and motor drive means for determining, in response to said output signal from said engine revolution sensing means, that said speed of said engine is within said middle-high engine-speed range, and for driving said rocker shaft to said second position as a result of said determination that said speed of said engine is within said middle-high engine-speed range.

19. A valve moving mechanism as set forth in claim 5, further comprising:

means for rotating said rocker shaft to a first position, when said engine is operating within a low engine-speed range, such that said second and third rocker arms will be in engagement with said second and third cams, while said first rocker arm will be out of engagement with said first cam as said cam shaft is rotated.

20. A valve moving mechanism as set forth in claim 5, further comprising:

means for rotating said rocker shaft to a second position, when said engine is operating within a middle-high engine-speed range, such that said second and third rocker arms will be out of engagement with said second and third cams, while said first rocker arm will be in engagement with said first cam as said cam shaft is rotated.

21. A valve moving mechanism as set forth in claim 19, wherein said means for rotating said rocker shaft comprises:

engine revolution sensing means for detecting said engine speed and for outputting a signal indicative of said engine speed; and motor drive means for determining, in response to said output signal from said engine revolution sensing means, that said speed of said engine is within said low engine-speed range, and for driving said rocker shaft to said first position as a result of said determination that said speed of said engine is within said low engine-speed range.

22. A valve moving mechanism as set forth in claim 20, wherein said means for rotating said rocker shaft comprises:

engine revolution sensing means for detecting said engine speed and for outputting a signal indicative of said engine speed; and motor drive means for determining, in response to said output signal from said engine revolution sensing means, that said speed of said engine is within said middle-high engine speed range, and for driving said rocker shaft to said second position as a result of said determination that said speed of said engine is within said middle-high engine speed range.

* * * * *